US006864154B2

(12) United States Patent
Yoon et al.

(10) Patent No.: US 6,864,154 B2
(45) Date of Patent: Mar. 8, 2005

(54) PROCESS FOR LAPPING WAFER AND METHOD FOR PROCESSING BACKSIDE OF WAFER USING THE SAME

(75) Inventors: Jeong-Goo Yoon, Suwon (KR); Ju-Young Park, Suwon (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 239 days.

(21) Appl. No.: 10/006,143

(22) Filed: Dec. 10, 2001

(65) Prior Publication Data

US 2003/0045073 A1 Mar. 6, 2003

(30) Foreign Application Priority Data

Sep. 5, 2001 (KR) ..... 2001-54519

(51) Int. Cl.[7] ..... H01L 21/02

(52) U.S. Cl. ..... 438/459; 438/977; 438/692

(58) Field of Search ..... 438/459, 977, 438/692, FOR 111, FOR 485

(56) References Cited

U.S. PATENT DOCUMENTS

| | | | | | |
|---|---|---|---|---|---|
| 5,641,714 | A | * | 6/1997 | Yamanaka | 438/14 |
| 5,840,614 | A | * | 11/1998 | Sim et al. | 438/464 |
| 5,893,746 | A | * | 4/1999 | Usami et al. | 438/455 |
| 5,981,391 | A | * | 11/1999 | Yamada | 438/690 |
| 6,030,485 | A | * | 2/2000 | Yamada | 156/344 |
| 6,162,701 | A | * | 12/2000 | Usami et al. | 438/455 |
| 6,462,415 | B1 | * | 10/2002 | Ishiguri et al. | 257/738 |
| 6,506,681 | B2 | * | 1/2003 | Grigg et al. | 438/692 |

FOREIGN PATENT DOCUMENTS

| | | |
|---|---|---|
| JP | 10-50642 | 2/1998 |
| JP | 2000-277469 | 10/2000 |

* cited by examiner

*Primary Examiner*—George Fourson
(74) *Attorney, Agent, or Firm*—Lowe Hauptman Gilman & Berner, LLP

(57) ABSTRACT

A process of lapping a wafer includes the steps of relieving adhesive stress of an ultraviolet tap attached to a first side of the wafer by irradiation of ultraviolet light, maintaining a lapping jig at a usable temperature of the ultraviolet tape to cause a binder applied to the lapping jig to be melted, bonding the first side of the wafer to the lapping jig, and lapping the wafer.

7 Claims, 2 Drawing Sheets

PROCESS FOR LAPPING WAFER AND METHOD FOR PROCESSING BACKSIDE OF WAFER USING THE SAME

BACKGROUND OF THE INVENTION

1. Field of the Invention

The present invention relates to a process for lapping the backside of a wafer with an ultraviolet tape attached to the front side thereof, and, more particularly, to a method for processing the backside of a wafer which is intended to carry out a lapping process for efficiently reducing damage of a wafer due to inherent adhesive stress of an ultraviolet tape used for protecting a circuit pattern formed on the front side of the wafer as well as a grinding process, thereby improving processing efficiency.

2. Description of the Prior Art

In a conventional process for manufacturing semiconductor products such as diodes, transistors and the like, a process for treating the backside of a wafer causing it to have a predetermined thickness (for example, about 200 $\mu$m) is involved. The process for treating the backside of a wafer comprises a grinding procedure or a lapping procedure. In the case of processing the backside of wafer, it is very important to protect a circuit pattern formed on the front side of the wafer.

In a conventional method for protecting the front side of a wafer, a process for applying a photoresist layer to the front side of a wafer to protect the pattern or a process for attaching a protecting tape to the front side of a wafer has been used.

A method for applying a photoresist layer to the front side of a wafer has an advantage in that it is capable of protecting the front side of a wafer reliably. That is, such a method for applying a photoresist layer can efficiently prevent damage to a wafer since the photoresist layer is hardly deformed by condition of a lapping jig on which the front side of the wafer is placed. Therefore, the method of applying a photoresist layer is easily adopted in a lapping process.

However, the method of applying a photoresist layer has disadvantages in that a substantial period of time is required to carry out the whole process and the process is considerably complicated because the process for coating a photoresist layer adapted to protect the front side of a wafer and a process for removing the photoresist layer after completion of a lapping process are required. For example, since an exposing process and a hard-baking process are involved in the process for coating a photoresist, and a wafer must be dipped into photoresist strip solution for 40 minutes and then washed in order to remove the photoresist layer after completion of the lapping process, the process becomes complicated. In addition, the process also has a problem in that a lapped thin wafer can be easily broken during elimination of the photoresist layer.

For overcoming the above disadvantages occurring in the method using a photoresist layer, a method for attaching a tape to the front side of a wafer has been used to protect a pattern formed to the front side. As such a tape for protecting the front side of a wafer, an ultraviolet tape, to which an adhesive containing ultraviolet curing agent is applied, is predominantly used. According to the conventional method for attaching a tape adapted to protect a pattern, a tape is attached to the front side of a wafer, a backside of the wafer is processed, and the tape is removed from the front side of the wafer.

Although the process for treating the backside of a wafer with an ultraviolet tape attached to the front side thereof can be more easily achieved as compared with the process with a photoresist layer, it has a serious drawback in that the process cannot be connected with a lapping process. That is, the front side of a wafer, to which an ultraviolet tape is attached, must be coupled to a lapping jig, but the ultraviolet tape attached to the lapping jig is apt to be deformed by condition of the lapping jig, and the thin wafer may be easily broken by inherent adhesive stress of the ultraviolet tape during a lapping process.

Accordingly, the process for treating the backside of a wafer with ultraviolet tape attached to the front side thereof can adopt only a grinding process in which a wafer is held under vacuum condition. Ultimately, since the process can carry out only a grinding process, it is difficult to expect a fine surface condition, which can be achieved by a lapping process.

As mentioned above, the process for treating the backside of a wafer with a photoresist layer applied to the front side thereof complicates a whole process by process for applying and removing a photoresist layer. Also, the process has a disadvantage in that the wafer is liable to be broken during a process relating to the photoresist. On the other hand, a process for treating the backside of a wafer is difficult to be adopted in a lapping process because of adhesive stress and thus deformation of an ultraviolet tape.

SUMMARY OF THE INVENTION

Accordingly, the present invention has been made keeping in mind the above problems occurring in the prior art, and an object of the present invention is to provide a process for lapping a wafer which can simplify the entire process and can overcome problems caused by inherent adhesive stress of a wafer and deformation of a wafer caused by the condition of a lapping jig, despite use of an ultraviolet tape in place of a photoresist layer.

It is another object of the present invention to provide a method for processing the backside of a wafer which can shorten the cycle time of a process and can achieve good surface roughness by using a grinding process effective to reduce the thickness of a wafer together with a lapping process with an ultraviolet tape.

In order to accomplish the above object, the present invention provides a process for lapping a second side of a wafer, which is provided at its first side with an ultraviolet tape attached thereto, comprising the steps of: irradiating the ultraviolet tape attached to the first side of the wafer with ultraviolet light; maintaining a lapping jig, to which the wafer is placed, at a temperature higher than the melting temperature of binder but lower than the deformation temperature of the ultraviolet tape; applying the binder to an upper surface of the lapping jig; bonding the second side of the wafer to the lapping jig via the binder; displacing the lapping jig having the wafer bonded thereto on a lapping plate; lapping the second side of the wafer causing the wafer to have a predetermined thickness; and removing the wafer from the lapping jig.

The lapping jig can be heated to a temperature suitable for an ultraviolet tape by placing the lapping jig on a hot plate for a predetermined period of time. As a binder, it is preferable to use Aqua wax having a relatively low melting temperature in order to ensure a stable temperature range. The temperature of the lapping jig is preferably maintained within a temperature range of about 45° C. to 85° C. so as to prevent deformation of the ultraviolet tape efficiently.

A method for processing the backside of a wafer according to the present invention comprises the steps of: attaching an ultraviolet tape to the front side of a wafer; grinding the backside of the wafer causing the wafer to have a first thickness; irradiating the ultraviolet tape attached to the front side of the wafer with ultraviolet light; lapping the backside of the wafer causing the wafer to have a second thickness; and removing the ultraviolet tape from the wafer.

According to another embodiment of the present invention, the step of lapping the backside of the wafer further comprises the steps of: bonding the front side of the wafer to an upper surface of a lapping jig via binder; lapping the backside of the wafer to cause the wafer to have a second thickness; and removing the wafer from the lapping jig.

The step of bonding the front side of the wafer to the lapping jig further comprises the step of maintaining the lapping jig at a temperature higher than the melting temperature of binder but lower than the deformation temperature of the ultraviolet tape.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1A:
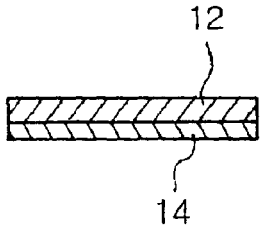
FIGS. 1*a* to 1*g* show a series of lapping processes according to an embodiment of the present invention.

Prior to description of the present invention, the terms "grinding process" and "lapping process" used herein will be defined for the sake of better understanding of the present invention. The grinding process is conventionally carried out to cut surfaces of a workpiece by means of a grinding wheel which consists of particles having a hardness higher than that of the workpiece and rotates at a high speed. The lapping process is conventionally carried in such a way that slurry which is prepared by adding particles having a hardness higher than that of a workpiece to fluid is applied between a plate and the workpiece, and the plate is rotated relative to the workpiece while the workpiece is rotated on its axis, thereby causing the workpiece to be worn away by the harder particles.

By the way, although the grinding process is effective in processing a wafer to reduce in its thickness by using only a grinding wheel, the final processed workpiece is deteriorated by surface roughness. On the other hand, although the lapping process is lowered in efficiency in processing the thickness of a wafer using a jig for holding the wafer, the processed workpiece is excellent in surface roughness.

Reference now should be made to the drawings, in which the same reference numerals are used throughout the different drawings to designate the same or similar components.

FIGS. 1*a* to 1*g* show a series of lapping processes according to an embodiment of the present invention. The process for lapping the backside of a wafer with an ultraviolet tape attached to the front side of a wafer according to the present invention will be described in detail with reference to the drawings.

Figure 1B:
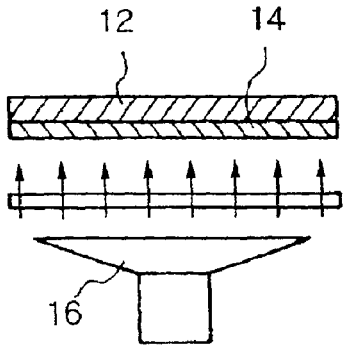
Figure 1C:
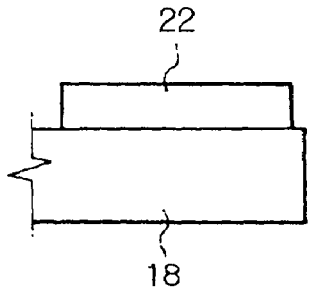

Referring to FIG. 1*a*, there is shown a wafer 12 to which an ultraviolet tape 14 is attached to protect a circuit pattern formed on a first surface thereof. As shown in FIG. 1*b*, the first surface of the wafer 12 having the ultraviolet tape attached thereto is irradiated by a predetermined amount of ultraviolet light emitted from an ultraviolet irradiator prior to a lapping process for a second surface of the wafer. By the irradiation of the ultraviolet light, adhesive stress of the ultraviolet tape 14 attached to the first surface of the wafer 12 is relieved. As such, the present invention is capable of preventing damage or breakage of the wafer 12, which may be caused by the adhesive stress of the ultraviolet tape 14 during a lapping process, by relieving the adhesive stress of the ultraviolet tape 14 in advance. After the irradiation of ultraviolet light, a lapping jig 22 is placed on a hot plate 18, as shown in FIG. 1*c*. In this procedure, the hot plate 18 serves to heat the lapping jig 22 to a reasonable temperature. In this heating procedure, a temperature of the lapping jig 22 is controlled such that the temperature is not lower than the melting temperature of binder for bonding the wafer 12 to the lapping jig 22 (about 45° C.) but not higher than a temperature at which the ultraviolet tape attached to the wafer is not deformed (about 85° C.).

Figure 1D:
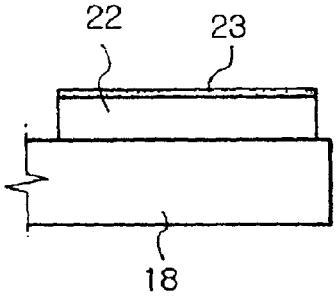

Referring to FIG. 1*d*, there is shown a procedure in which binder 23 is applied to the lapping jig 22. The lapping jig 22 is heated to its melting temperature or higher, thereby causing the binder to melt. As the binder, it is possible to use a binder having a melting temperature within the allowable temperature range of the ultraviolet tape, i.e. within the temperature range at which the ultraviolet tape is not deformed. For example, although the binder can include paraffin wax, Aqua wax and the like, it is preferable to use Aqua wax in terms of appropriateness of melting temperature and environmental pollution.

Figure 1E:
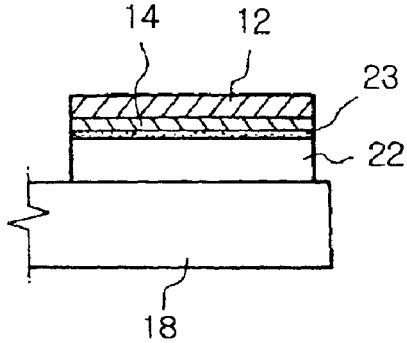

Referring to FIG. 1*e*, there is shown the wafer 12 and the ultraviolet tape 14 attached thereto which are bonded to an upper surface of the lapping jig 22 by means of the melted binder 23. Since the lapping jig 22 is maintained between the reasonable temperature range, i.e. between the temperature range at which the ultraviolet tape is not deformed (about 85° C.), by the hot plate 18, it is possible to prevent breakage of the wafer caused by inherent adhesive stress of the ultraviolet tape.

Figure 1F:
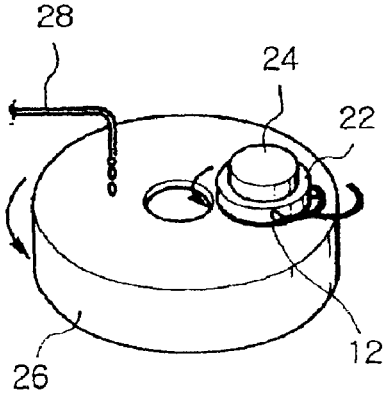
Figure 1G:
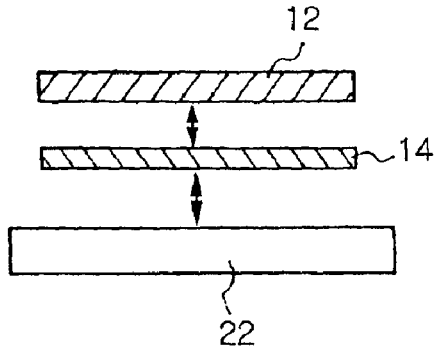

Thereafter, the lapping jig 22, to which the wafer 12 is bonded, is placed on a lapping plate 26 such that the backside of the wafer 12 faces downward, and a pusher 24 is then placed on the lapping jig 22, as shown in FIG. 1*f*. Subsequently, a predetermined amount of slurry is applied through a feeding tube 28 to carry out a lapping process. As with a conventional process, upon actuating the lapping apparatus, the lapping plate 26 is rotated. By rotation of the lapping plate 26, the lapping plate 26 is rotated relative to the lapping jig 22 while the lapping jig 22 is rotated on its axis in the same direction as the rotating direction of the lapping plate 26, so that the backside of the wafer 12 disposed below the lapping jig 22 is lapped by the slurry.

After completion of the lapping procedure, the wafer 12 is removed from the lapping jig 22 together with the ultraviolet tape 14 attached thereto, and the ultraviolet tape 14 is then detached from the wafer 12.

As described above, the present invention is characterized in that ultraviolet tape attached to a first surface of a wafer is irradiated by ultraviolet light to relieve adhesive stress prior to a lapping procedure. The first surface of the wafer is placed on a lapping jig with the ultraviolet tape attached thereto, and the temperature of the lapping jig is controlled within a usable temperature range of the ultraviolet tape causing binder to melt, thereby preventing deformation of the ultraviolet tape. Accordingly, the present invention can effectively fulfill a lapping process by overcoming breakage of a wafer which is generated owing to adhesive stress of an ultraviolet tape when the wafer is attached to a lapping jig via the ultraviolet tape, even though the invention uses the ultraviolet tape as means for protecting a front side of the wafer.

Figure 2:
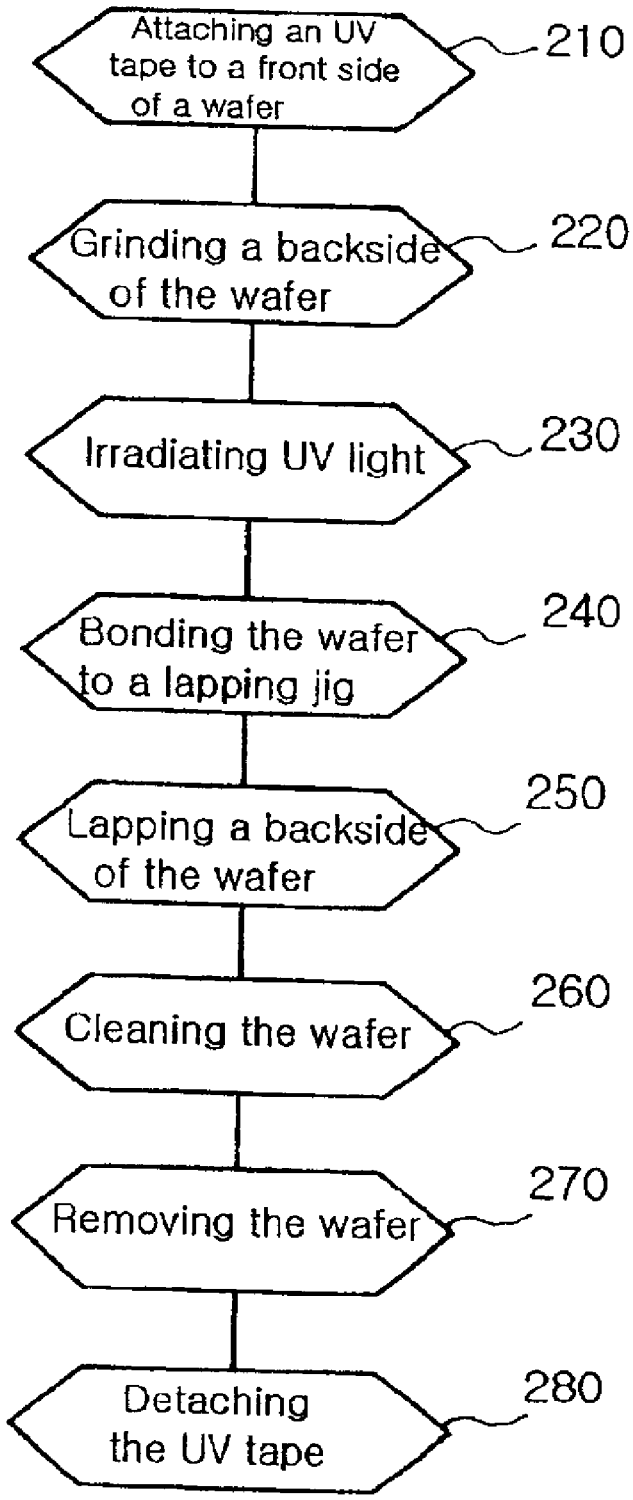
FIG. 2 is a flow chart illustrating a method for processing the backside of a wafer according to another embodiment of the present invention.

Referring to FIG. 2, there is shown a flow chart illustrating a method for processing the backside of a wafer according to another embodiment of the present invention in which the above lapping process is adopted. As illustrated in the drawing, an ultraviolet tape is first attached to a front side of a wafer (Step 210). The backside of the wafer is ground using a conventional grinding apparatus (Step 220). In this step, the wafer is hardly subjected to breakage owing to adhesive stress of the ultraviolet tape since the wafer is held by a vacuum chuck of the grinding apparatus. In particular, since the grinding process can etch more wafer material as compared with a lapping process, the wafer can be easily etched to a desired thickness in a shorter period of time as compared with the lapping process.

After completion of the grinding process, the ultraviolet tape attached to the front side of the wafer is irradiated by means of an ultraviolet irradiator (Step 230). Though adhesive stress of the ultraviolet tape is eliminated by the irradiation of ultraviolet light, the wafer is subjected to a subsequent lapping process with the ultraviolet tape attached thereto. Thereafter, a lapping jig is heated by a hot plate to a temperature, which is higher than a melting temperature of binder but lower than a deformation temperature of the ultraviolet tape. The wafer is bonded to the lapping jig via the melted binder (Step 240). The lapping jig having the wafer bonded thereto is placed on a lapping plate, and a lapping process is initiated (Step 250). The lapping process conducted in this step is essentially identical to the lapping process illustrated in FIG. 1.

Accordingly, since the present invention adopts an additional lapping process capable of achieving fine etching and an enhanced surface roughness into its process, the wafer can be precisely controlled to a desired thickness, and the surface roughness of a wafer deteriorated by the grinding process can be enhanced by the grinding process.

After completion of the lapping process, unwanted particles of the wafer generated during the lapping process are eliminated by a washing procedure (Step 260). Subsequently, the wafer is removed from the lapping jig (Step 270), and the ultraviolet tape is detached from the wafer (Step 280). Accordingly, the wafer can be easily ground to a desired thickness and its surface roughness can be improved by carrying out the additional lapping process.

The above-mentioned method for processing the backside of a wafer can simplify an entire process to shorten a period required to complete the process and can minimize damage of a wafer by carrying out a lapping process capable of achieving an excellent surface condition as well as a grinding process capable of increasing the amount of a wafer etched.

As described above, the present invention provides a process for lapping a wafer which is carried out in such a way that adhesive stress of an ultraviolet tape attached to a first side of a wafer is relived by irradiation of ultraviolet light, and a lapping jig, with which the ultraviolet tape attached to the front side of the wafer is in contact, is maintained to a usable temperature of the ultraviolet tape at which the binder can be melted, thereby preventing damage of a wafer owing to adhesive stress of the ultraviolet tape. Furthermore, the present invention can simplify a whole process to shorten a period required to complete the process and can minimize damage of a wafer by carrying out a lapping process as well as a grinding process.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A process of lapping a second side of a wafer, which is provided at a first side thereof with a ultraviolet tape attached to said first side, said method comprising the steps of:

irradiating the ultraviolet tape attached to the first side of the wafer with ultraviolet light;

maintaining a lapping jig, on which the wafer is to be placed, at a temperature higher than a binder's melting temperature but lower than a deformation temperature of the ultraviolet tape;

applying the binder to an upper surface of the lapping jig;

bonding the first side of the wafer to the lapping jig via the binder;

placing the lapping jig having the wafer bonded thereto on a lapping plate;

lapping the second side of the wafer to cause the wafer to have a predetermined thickness; and removing the wafer from the lapping jig;

wherein said irradiating step is performed before said lapping step.

2. The method of claim 1, wherein said irradiating step is performed before said bonding step.

3. A method of processing a backside of a wafer, said method comprising the steps of:

attaching a ultraviolet tape to a front side of the wafer;

grinding the backside of the wafer to cause the wafer to have a first thickness;

irradiating the ultraviolet tape attached to the front side of the wafer with ultraviolet light;

maintaining a lapping jig at a temperature higher than a binder's melting temperature but lower than a deformation temperature of the ultraviolet tape;

applying the binder to an upper surface of the lapping jig;

bonding the front side of the wafer to the lapping jig via the binder;

placing the lapping jig having the wafer bonded thereto on a lapping plate;

lapping the backside of the wafer to cause the wafer to have a second thickness;

removing the wafer from the lapping jig; and removing the ultraviolet tape from the wafer;

wherein said irradiating step is performed before said lapping step.

4. The method of claim 3, wherein said irradiating step is performed before said bonding step.

5. A method of processing a wafer, said method comprising the steps of:

attaching a ultraviolet tape to a first side of the wafer;

irradiating the ultraviolet tape with ultraviolet light to relieve adhesive stress of the ultraviolet tape;

lapping a second, opposite side of the wafer to reduce a thickness of the wafer; and removing the ultraviolet tape from the wafer;

wherein said irradiating step is performed before said lapping step.

6. The method of claim 5, further comprising bonding the first side of the wafer to a lapping jig via a binder before said lapping and after said irradiating.

7. The method of claim 6, wherein, in said bonding step, the ultraviolet tape is bonded to the lapping jig via the binder.

* * * * *